United States Patent [19]

Tanikawa et al.

[11] Patent Number: 4,607,416

[45] Date of Patent: Aug. 26, 1986

[54] FLUID-TIGHT SLIDE FASTENER

[75] Inventors: Koichi Tanikawa, Toyama; Toshiaki Takizawa, Kurobe, both of Japan

[73] Assignee: Yoshida Kogyo K.K., Tokyo, Japan

[21] Appl. No.: 729,403

[22] Filed: May 1, 1985

[30] Foreign Application Priority Data

May 10, 1984 [JP] Japan ..... 59-68414[U]

[51] Int. Cl.[4] ..... A44B 19/02; A44B 19/32

[52] U.S. Cl. ..... 24/389; 24/384; 24/393

[58] Field of Search ..... 24/384, 389, 390, 393, 24/397

[56] References Cited

U.S. PATENT DOCUMENTS

| | | | |
|---|---|---|---|
| 3,668,745 | 6/1972 | Krupp | 24/389 |
| 3,974,550 | 8/1976 | Fujisaki et al. | 24/393 |
| 4,041,577 | 8/1977 | Matsuda | 24/393 |
| 4,042,735 | 8/1977 | Yoneya | 24/389 |
| 4,064,602 | 12/1977 | Heimberger | 24/393 |
| 4,228,566 | 10/1980 | Matsuda | 24/393 |
| 4,265,003 | 5/1981 | Matsuda | 24/393 |
| 4,378,683 | 4/1983 | Matsuda et al. | 24/393 |

FOREIGN PATENT DOCUMENTS

| | | | |
|---|---|---|---|
| 1438244 | 6/1976 | United Kingdom | 24/389 |

*Primary Examiner*—Victor N. Sakran

*Attorney, Agent, or Firm*—Hill, Van Santen, Steadman & Simpson

[57] ABSTRACT

A fluid-tight slide fastener comprises a pair of stringer tapes each having an inner edge region, an outer edge region and a stretchable region intermediate between the two edge regions which are non-stretchable. The intermediate stretchable region yieldingly takes up any transverse stresses which would otherwise act upon the inner edge region to split apart the fastener halves and produce leakage therethrough.

9 Claims, 13 Drawing Figures

FLUID-TIGHT SLIDE FASTENER

BACKGROUND OF THE INVENTION

1. Field of the Invention

This invention relates to slide fasteners, more particularly to a fluid-tight slide fastener for use on ski clothing, sports bags and other articles which require sealing against rain, snow, wind or dust.

2. Prior Art

Gas- or liquid-tight slide fasteners are known, a typical example of which comprises a pair of fastener stringers and sealing strips applied to the respective stringers at least over one surfaces of thereof, the sealing strip being formed from rubber, plastics film and other elastomeric materials. The sealing strips were laid over the respective stringers with their confronting edges slightly projecting beyond the central axis of symmetry defined by two coupling element rows in engagement or beyond the extremities of the longitudinal edges of the stringer tapes along where the coupling elements were mounted. When the slide fastener was closed, the confronting edges of the sealing strips were brought deformably into abutting engagement with each other to produce a tight seal therealong, with the coupling elements concealed completely from external view. However, when severe transverse pull or stresses were applied to such slide fasteners, the sealing strips were susceptible to separation to create a leakage path along their confronting edges largely due to the stringer tapes being non-stretchable or unyieldable. This tendency has become pronounced in instances where the slide fastener was applied to ski wear or other vehemently handled articles.

SUMMARY OF THE INVENTION

With the foregoing difficulties of the prior art in view, the present invention provides a fluid-tight slide fastener which is capable of maintaining a complete seal against external atmosphere when in use on sports wear and other vehemently handled articles.

Another object of the invention is to provide a slide fastener which is not only completely fluid-tight but also can be applied to articles firmly and positionally accurately.

According to the invention, a fluid-tight slide fastener comprises a pair of stringer tapes each having an inner edge region, an intermediate region and an outer edge region, rows of compling elements secured to the respective tapes, a slider for taking said rows of coupling elements into and out of engagement with each other, and an elastically deformable sealing strip applied at least onto one side of each of the tapes. The sealing strip is substantially coextensive with the tape but having an inner edge projecting slightly beyond the extremity of the inner longitudinal edge of the tape. The tape includes stretchable threads in the intermediate region to render this region stretchable transversely of the tape, while the inner and outer edge regions are non-stretchable.

The invention will be better understood with reference to the following description taken in conjunction with the accompanying drawings in which like numerals denote like and corresponding parts.

DETAILED DESCRIPTION

Figures 1, 2:
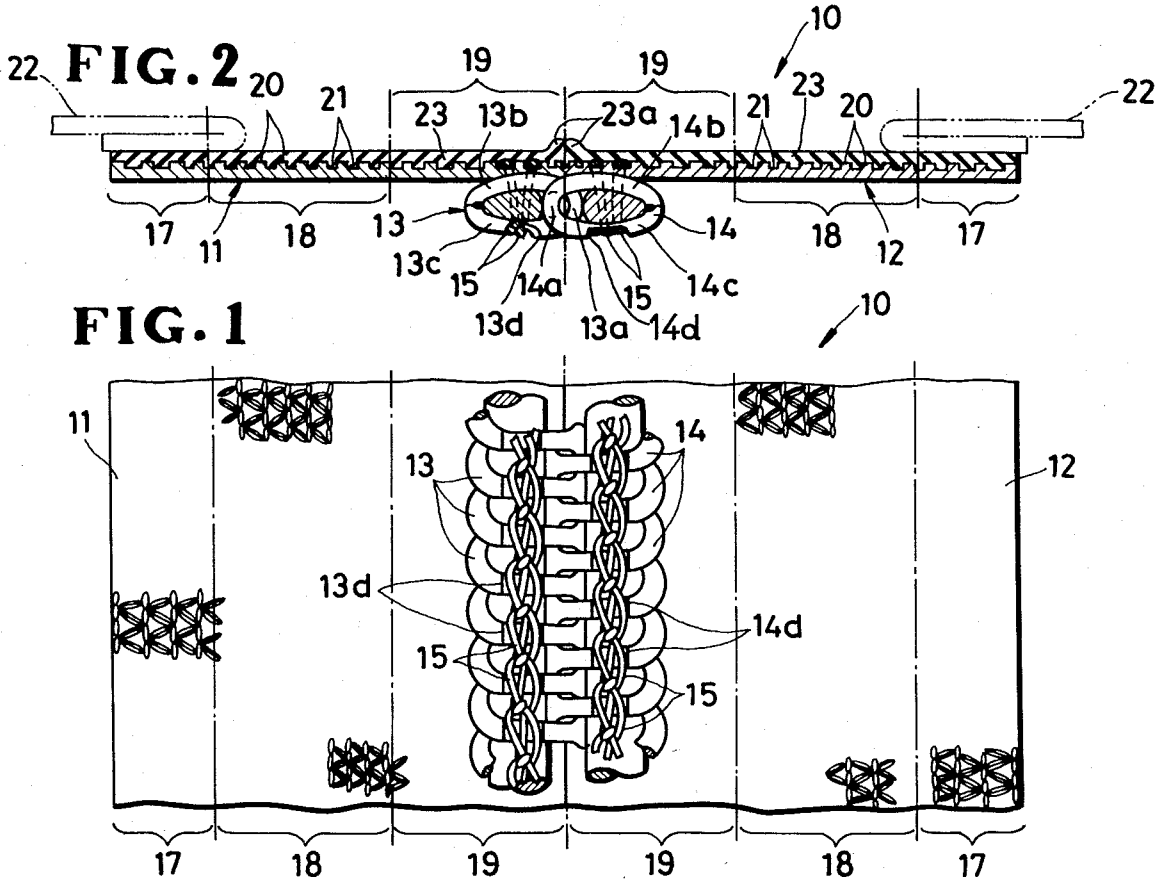
FIG. 1 is a rear fragmentary plan view of a slide fastener according to a preferred embodiment of the invention.
FIG. 2 is a reversed transverse cross-section of FIG. 1.

FIGS. 2 shows a slide fastener 10 having a fluid-tight construction which comprises a pair of stringer tapes 11 and 12 and a pair of rows of coupled coupling elements 13 and 14 which are secured to the tapes 11 and 12, respectively, by a sewn seam 15 such as of chain locked stitches. The rows of coupling elements 13 and 14 are brought into and out of mutual engagement by a slider (not shown) to close and open the fastener 10 in a well known manner.

Figure 3:
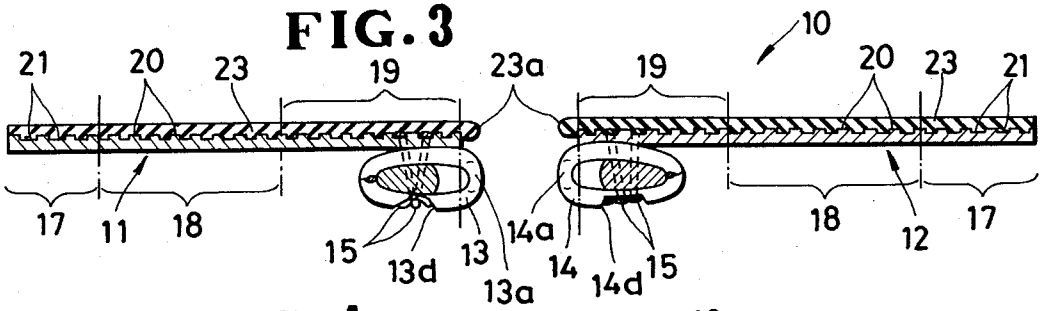
FIG. 3 is a cross-sectional view of the slide fastener of FIG. 2, showing its respective halves disengaged and separated.
Figure 4:
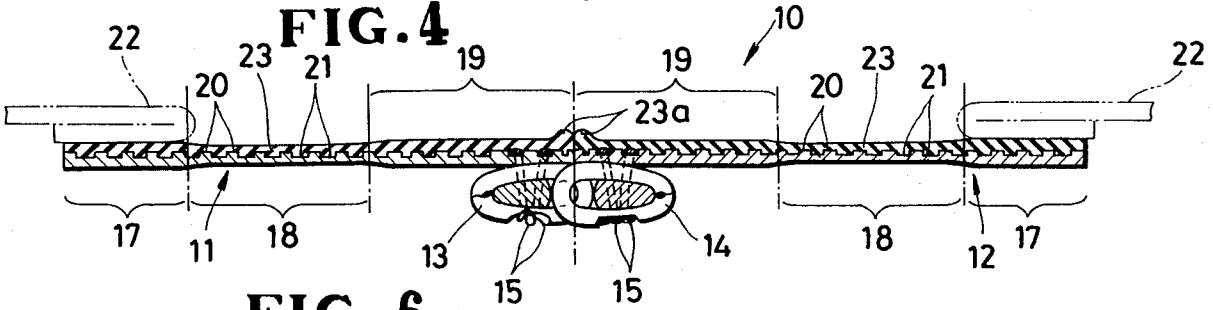
FIG. 4 is a view similar to FIG. 1 but showing the slide fastener in stressed condition.
Figure 5:
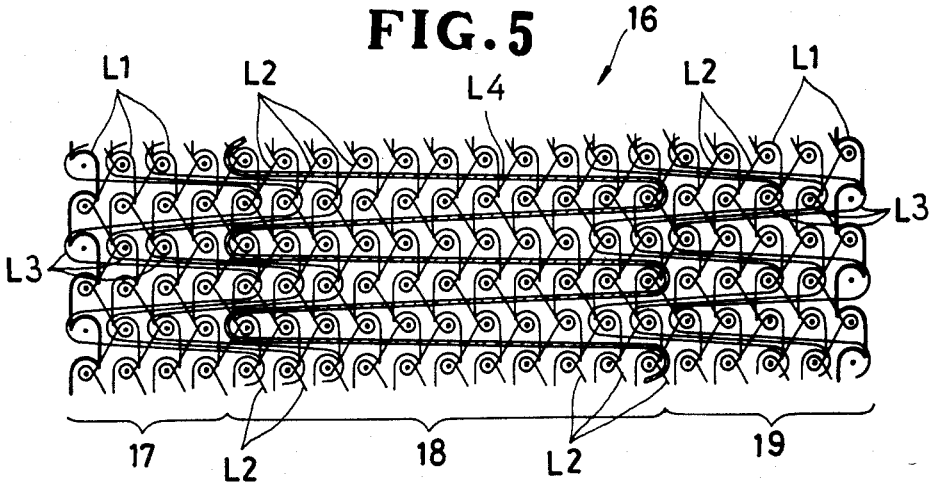
FIG. 5 is a schematic diagram of a stringer tape system used according to the invention.

In the embodiment shown in FIGS. 1–6 inclusive, the stringer tapes 11 and 12 are each formed by a knit system 16 exemplified in FIG. 5. The knit tape system 16 comprises an inner longitudinal edge region 19, an intermediate region 18 and an outer longitudinal region 17. The outer longitudinal edge region 17, to which an article 22 is secured, is formed by warp threads L1, tricot threads L2 both forming wales 20 (FIG. 1) alternating with grooves 21, and weft threads L3 extending over five of these wales. The inner longitudinal edge region 19, to which the coupling elements 13 and 14 are secured, is of a system similar to the outer edge region 17 and comprises warp threads L1, tricot threads L2 and weft threads L3 extending over five wales 20. The innermost and outermost warp threads L1 are made of a reinforcing thread stronger than the rest of the warp threads so as to solidify the extremities of the respective edge regions 17 and 19.

The intermediate region 18 consists of warp threads L1, tricot threads L2 and weft threads L4 extending over eleven wales 20. The weft threads l4 in this region are made of a stretchable material such as spandex for pusposes hereafter to be described.

The rows of coupling elements 13 and 14 illustrated to be in the form of a continuous helical coil are secured to the respective stringer tapes 11 and 12 on their flat sides and along their inner edge regions 19 by sewn seams 15. Each element has a coupling head **13*a*, (14*a*) and upper and lower legs 13*b*, 13*c*, (14*b*, 14*c*), the lower leg having a recess 13***d*, (14*d*) for receiving sewing threads of the seam 15.

The opposite side of each stringer tape 11, (12) has the alternate wales 20 and grooves 21 extending longitudinally of the tape and is covered by a sealing strip 23 made of an elastically deformable material such as rubber, soft synthetic rsins or other elastomeric materials. The sealing strip 23 is substantially coextensive with the tape 11, (12) but has its inner longitudinal marginal edge 23*a* projecting slightly beyond the extremity of the inner tape edge region 19, as shown in FIG. 3, so that the projecting edge 23*a* bears deformably against the counterpart 23*a* of the opposed mating strip 23 to effect a sealing action when the fastener halves are coupled together as shown in FIGS. 2 and 4.

When thus coupling the two stringer tapes 11 and 12 of the fastener 10, the coupling elements 13, 14 receive stresses tending to move inwardly toward each other. This movement is averted by the arrangement in which the sewing threads are firmly anchored in the recesses 13*d*, 14*d* of the individual elements 13, 14 against displacement thereof which would otherwise occur under the influence of transverse stresses.

The sealing strip 23 may be secured to the respective tape 11, (12) by high frequency, supersonic or other heating technique, in which instance the material of the sealing strip 23 is embedded in the grooves 21 of the knit surface system thereby enhancing the bond between the strip 23 and the tape 11, (12). The strip 23 may be secured also by an adhesive compound or even additionally by stitching because the needle threads will become instantly seized and intimately compacted by the elastic action of the sealing material surrounding the threads, thereby retaining fluid-tightness.

According to an important aspect of the invention, the intermediate region 18 of the respective stringer tape 11, (12) extending longitudinally between the inner and outer edge regions 19 and 17 includes laid-in weft threads L4 which are resilient and stretchable whereby the region 18 and the portion of the sealing strip 23 lying thereover are rendered yieldingly stretchable upon the application of transverse pull to the fastener 10. Thus, when stresses develop transversely of the fastener 10, such stresses are readily taken up or absorbed by the intermediate stretchable region 18 (including the sealing strip 23 coextensive therewith) without being distributed to the inner edge region 19 on which the coupling elements 13, 14 are mounted. Such stresses would have otherwise previously caused the stringer tapes 11, 12 to split apart along the confronting edges 23*a* of the respective sealing strips 23, resulting in fluid leakage.

The knit pattern shown in FIG. 5 is commonly known as "tricot" which is per se strechable to some extent. The use of particularly stretchable threads such as spandex in the region 18 intermediate between the inner and outer edge regions 19 and 17 of the tape renders these edge regions less stretchable and stiffer as desired. It will be understood that the omission of tricot stitches L4 in the intermediate region 18 will give rise to stretchability of the same region.

Figure 6:
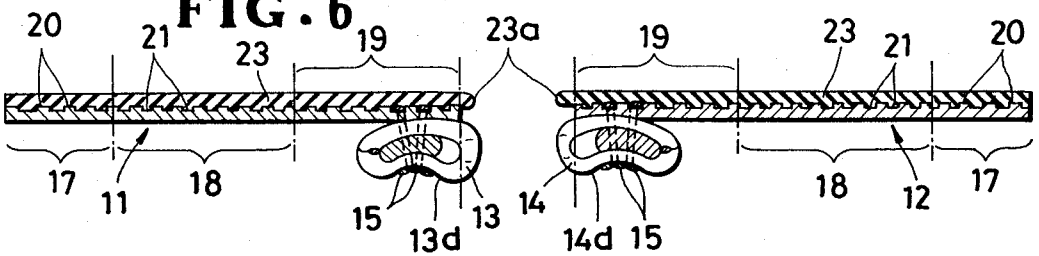
FIG. 6 (appearing with FIG. 3) is a view similar to FIG. 3 but showing a different form of fastener coupling elements.

FIG. 6 shows a modification the coupling element 13, (14) in which the lower leg 13*c*, (14*c*) is deformed to produce an indentation functionally similar to the recess 13*d*, (14*d*) for holding the sewing threads in place against movement when transverse pull is exerted.

Figure 8:
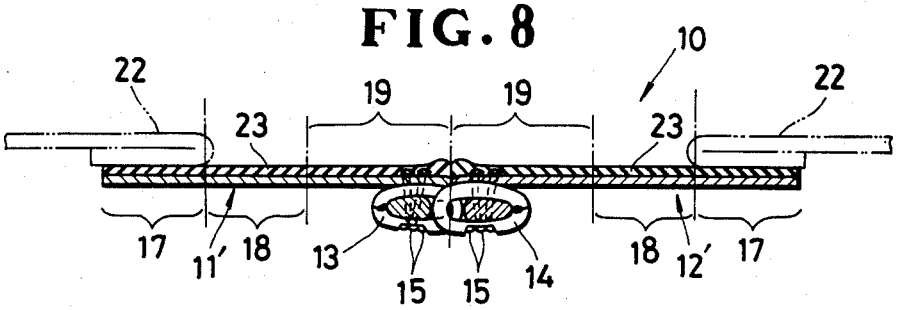
FIG. 8 is a reversed transverse cross-section of FIG. 7.
Figure 7:
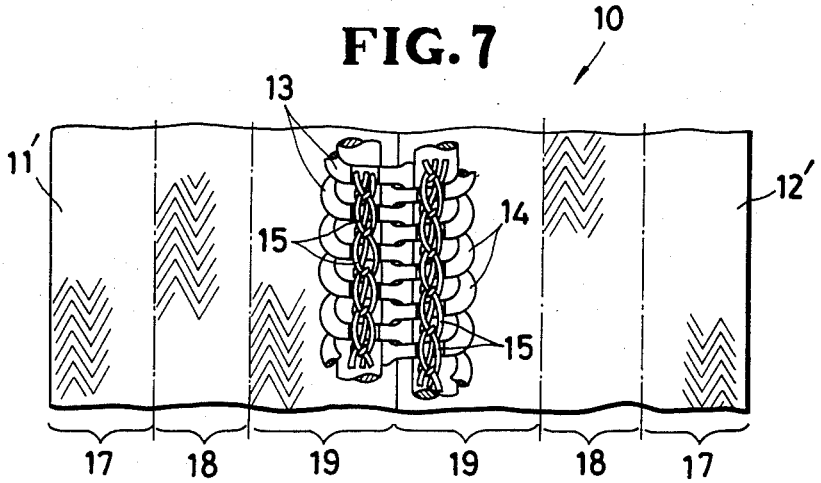
FIG. 7 is a view similar to FIG. 1 but showing a different embodiment of the invention
Figure 9:
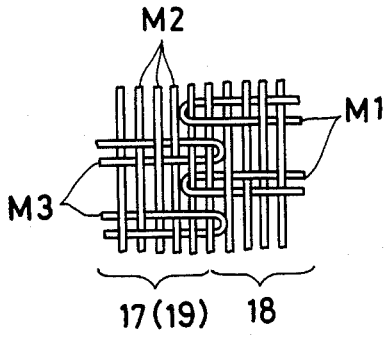
FIG. 9 is a schematic diagram of a stringer tape system used in the embodiment shown in FIGS. 7 and 8.

FIGS. 7–9 inclusive show another embodiment of the invention which is similar to the above advanced embodiment except that the stringer tapes 11' and 12' are woven. In this woven tape system, as shown in FIG. 9, the intermediate region 18 includes stretchable weft threads M1 interlaced with non-strechable warp threads M2, while the outer and inner edge regions 17, 19 include non-stretchable weft threads M3 interlaced with the non-stretchable warp threads M2. The advantages of this tape structure are the same as described in connection with the first embodiment.

Figure 10:
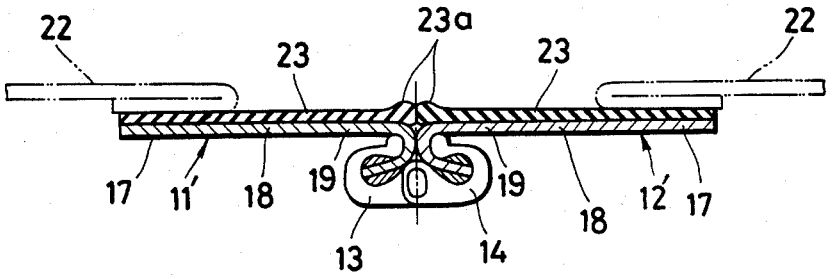
FIGS. 10 and 11 show a further embodiment of the invention.
Figure 11:
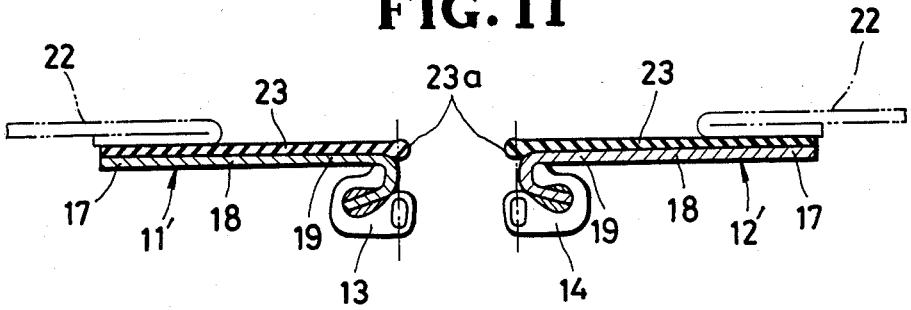

FIGS. 10 and 11 show a further embodiment in which the basic concept of the invention remains the same except for the use of a concealed type of coupling element 13, (14) which type is well known in the art.

Figure 12:
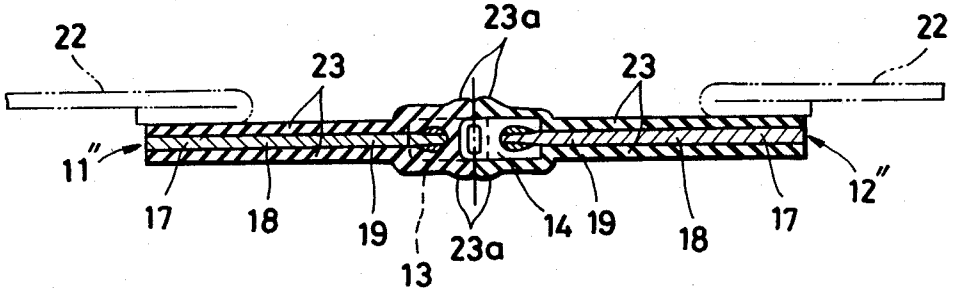
FIGS. 12 and 13 show still another embodiment of the invention.
Figure 13:
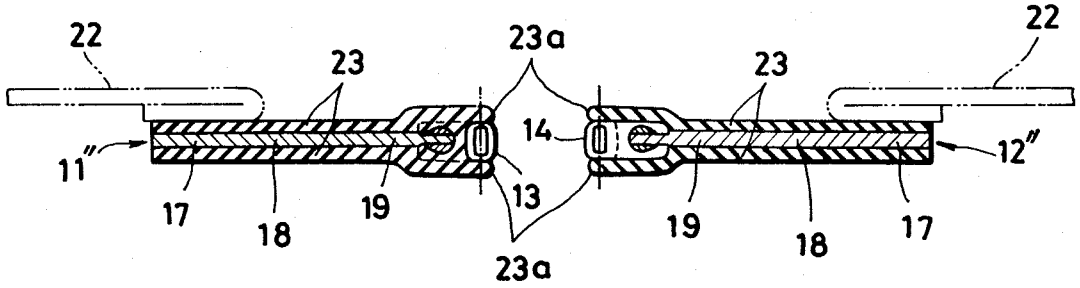

FIGS. 12 and 13 show still another embodiment in which the principles of the invention are applied to a fastener having metal coupling elements 13, 14 mounted astride the inner longitudinal edges of the respective tapes 11'', 12'' with the sealing strip 23 applied to both sides of the tapes including stretchable intermediate regions 18.

Although various minor modifications may be suggested by those versed in the art, it should be understood that we wish to embody within the scope of the patent warranted hereon, all such embodiments are reasonably and properly come within the scope of our contribution to the art.

What is claimed is:

1. A fluid-tight slide fastener comprising:

(a) a pair of stringer tapes each having an inner edge region, an intermediate region and an outer edge region, said tape incorporating stretchable threads in said intermediate region to render this region stretchable transversely of said tape, and said inner and outer edge regions both being non-stretchable;

(b) a pair of rows of coupling elements secured to the inner edge regions of the respective tapes;

(c) a slider for taking said rows of coupling elements into an out of engagement with each other; and (d) a pair of elastically deformable sealing strips secured respectively onto one side of each of said tapes remotely from said coupling elements, said sealing strip having a width substantially coextensive with the width of said tape, but having an inner edge projecting in its free state slightly beyond the inner longitudinal edge of said inner edge region of said tape.

2. A fluid-tight slide fastener according to claim 1, said stringer tape including a knit system having a waled side to which said sealing strip is secured and incorporating a stretchable weft thread in said intermediate region to render this region alone stretchable transversely of the tape.

3. A fluid-tight slide fastener according to claim 2, said stretchable thread being spandex.

4. A fluid-tight slide fastener according to claim 1, said stringer tape including a weave system incorporating a stretchable weft thread in said intermediate region overlaid by said strip to render this region alone stretchable transversely of the tape.

5. A fluid-tight slide fastener according to claim 4, said stretchable thread being spandex.

6. A fluid-tight slide fastener according to claim 1, said coupling element having a recess for receiving sewing threads to hold the latter in place against movement transverse of the tape.

7. A fluid-tight slide fastener comprising:

(a) a pair of stringer tapes each including a knit system having a plurality of longitudinal wales on one surface of each tape, said knit system including a pair of non-stretchable inner and outer edge regions and a transversely stretchable intermediate region incorporating a stretchable weft thread;

(b) a pair of rows of coupling elements secured to the respective inner edge regions of said stringer tapes;

(c) a slider slidably mounted on said pair of rows of coupling elements for interengaging and disengaging the latter to close and open the slide fastener; and (d) an elastically deformable sealing strip secured to said one surface of each said tape and having an inner edge projecting slightly beyond an inner longitudinal edge of each said tape.

8. A fluid-tight slide fastener according to claim 7, said strechable weft thread being spandex.

9. A fluid-tight slide fastener according to claim 7, further including sewing threads securing said rows of coupling elements respectively to said tapes, each said coupling element having a recess receiving said sewing threads to prevent the latter from being displaced longitudinally of said coupling element.

* * * * *